United States Patent [19]

Lejon

[11] 4,326,448

[45] Apr. 27, 1982

[54] ELECTRONIC REGULATION PROCEDURES USING A SERVOMOTOR

[75] Inventor: Jean Lejon, Choisel, France

[73] Assignee: Controle Bailey, Clamart, France

[21] Appl. No.: 144,907

[22] Filed: Apr. 29, 1980

Related U.S. Application Data

[63] Continuation of Ser. No. 907,497, May 19, 1978, abandoned.

[30] Foreign Application Priority Data

Aug. 10, 1977 [FR] France ..... 77 24600

[51] Int. Cl.[3] ..... F15B 9/03; F15B 9/09

[52] U.S. Cl. ..... 91/363 R; 91/374; 91/390; 92/29

[58] Field of Search ..... 91/374, 361, 363 R, 91/390

[56] References Cited

U.S. PATENT DOCUMENTS

| | | | |
|---|---|---|---|
| 2,470,099 | 5/1949 | Hall | 91/374 |
| 2,496,391 | 2/1950 | Hall | 91/374 |
| 2,601,157 | 6/1952 | LeLan | 91/363 R |

*Primary Examiner*—Paul E. Maslousky

*Attorney, Agent, or Firm*—Pearne, Gordon, Sessions, McCoy & Granger

[57] ABSTRACT

A process for controlling pneumatic servomotor of the type comprising a control by a motor jack supplied with pressurized fluid by a pressure modulator of said fluid and a first slaving loop causing said jack to slave in a given reference position, wherein each reference position is stored in analogue manner by movable mechanical friction means carrying said modulator and displaced by means of a second disengageable slaving loop which is substituted for the first during reference position changes and which takes its displacement energy for the movable mechanical means directly from the motor jack.

7 Claims, 3 Drawing Figures

ELECTRONIC REGULATION PROCEDURES USING A SERVOMOTOR

Figure 1:
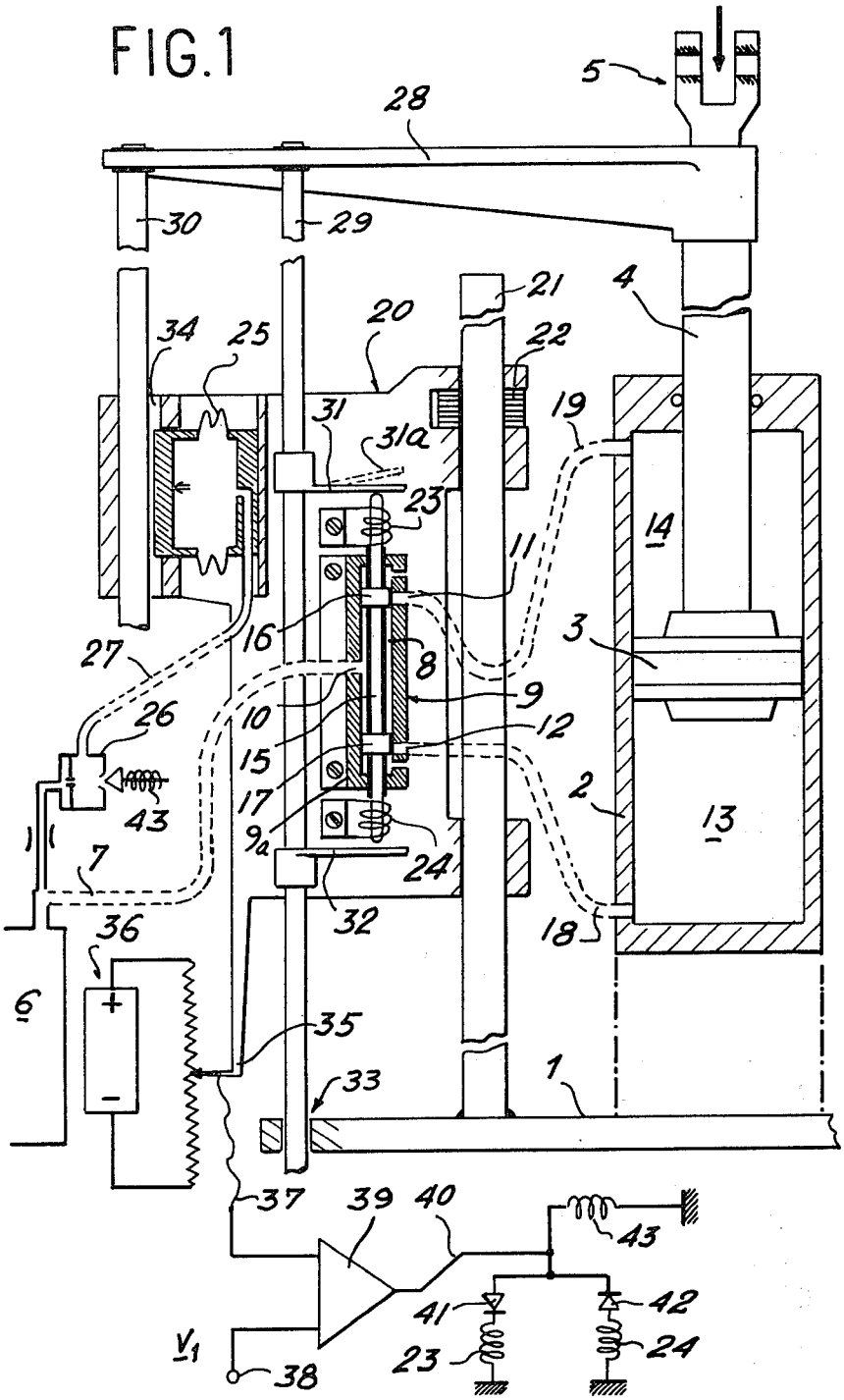

This is a continuation of application Ser. No. 907,497, filed May 19, 1978, now abandoned.

The present invention relates to electronic regulation procedures using a servomotor, whereby a member is forced to occupy a given position, which is variable in time.

The known electronic regulation equipment at present used in industry either employ electrical or pneumatic servomotors.

In the case of electrical servomotors the apparatus is generally controlled incrementally and forcing to occupy the desired position is brought about by retransmitting the instantaneous position by means of a position detector and control of the positioning motor on the basis of a divergence signal between the two positions. The great advantage of this type of servomotor is that if for any reason there is any interruption to the power supply through the electrical control line the system remains operative because the positioning motor is no longer supplied. Conversely it is known that such electrical servomotors are very costly and in fact cost four to fives times the price of an equivalent pneumatic servomotor. In addition, their reliability is relatively dubious because it is necessary to associate a thyristor control system and a mechanical reduction gear with the generally low inertia motor, because the latter generally operates at high speed, thus making the apparatus sensitive.

Pneumatic servomotors are much more reliable because their design is simpler and their cost is significantly lower. However, they unfortunately have the following major disadvantage. The servomotor position is generally defined by that of the rod of a double acting piston, whose position changes are controlled by variations in the pressure applied to each of the two faces of the piston and the desired reference position is brought about by an internal slaving of the apparatus from an electrical control signal which is the analogue image of the piston travel in the jack body. Thus, a biunivocal correspondence is obtained between the value of the electrical control signal and the position of the piston in the jack body. The main disadvantage of this system is that in the case of an interruption of the electrical line or the regulation supply the electrical signal disappears and the servomotor relatively rapidly returns to its position corresponding to the zero signal. Obviously this can be catastrophic for certain fine control or monitoring operations of industrial installations. For example this is the case with the control of a thermal power station where it is thus possible to bring about the closing of a valve in a very short time and on closing it blocks the action of the boiler and can lead to the cutting out of the complete power station. In a nuclear reactor where the control rods are controlled by a servomotor an interruption in the power supply is sufficient to bring about the dropping of the rods and the stopping of the chain reaction. Attempts have been made to compensate this difficulty by ensuring that the bottom position (that corresponding to the zero electrical control signal) of the electropneumatic servomotor is the safety position, which although eliminating the more serious disadvantages does not generally prevent the shutting down of a complete installation.

Thus, at present no servomotor combines the advantages of the two above types, which is unfortunate because pneumatic servomotors generally have on their compressed air supply system a storage reservoir which generally gives between 10 and 30 minutes of autonomy to the system, even in the case of a general interruption to the power supply of the compressors and hitherto use has not been made of this possibility.

The object of the present invention is an electropneumatic servomotor with a memory system which utilises this energy stored in the form of compressed air in order to provide a memory and retain its position if the electric power supply is interrupted.

More specifically the invention has for its object a process for controlling a pneumatic servomotor and the apparatus for performing this process.

The invention therefore relates to a process for controlling a pneumatic servomotor of the type comprising a control by a motor jack supplied with pressurised fluid by a pressure modulator of said fluid and a first slaving loop causing said jack to slave in a given reference position, wherein each reference position is stored in analogue manner by movable mechanical friction means carrying said modulator and displaced by means of a second disengageable slaving loop which is substituted for the first during reference position changes and which takes its displacement energy for the movable mechanical means directly from the motor jack.

According to a first embodiment of the invention the mechanical friction means are movable in translation, the state of said translation being representative in analogue manner of the reference position of the servomotor.

According to a second embodiment of the invention the mechanical friction means are movable in rotation and it is the state of said rotation which is representative in analogue manner of the reference position of the servomotor.

According to the invention the apparatus for performing the above process is characterised in that it comprises:

- a memory plate movable with friction carrying the pressure modulator and means for measuring the position of said plate at all times;
- a first loop for controlling the servomotor about its reference position comprising first means for connecting the rod of the motor piston to the pressure modulator controls, said connecting means having a mechanical flexibility permitting slight temporary displacements of the modulator controls relative to the plate;
- a second slaving loop for displacing the memory plate during the passage from one reference position to another and having second disengageable connecting means between the rod of the motor jack and said memory plate, as well as means for eliminating the first slaving loop by acting simultaneously with the clutch of said connecting means on the pressure modulator controls.

According to a preferred embodiment of the apparatus according to the invention the electropneumatic servomotor with a memory system is of the type comprising a pressurised air control member having a compressed air source with a certain reserve, a double acting jack whose rod materialises the reference position of the member to be controlled, as well as a compressed air distribution relay constituted by a slide valve movable in translation in a cylindrical cavity of the body of said relay communicating with three nozzles, whereof the first ensures the permanent supply of pressurised air and the two others ensure the distribution of said air respectively in each of the chambers of the double acting jack, wherein it is also equipped with:

first means for connecting the jack rod with the slide valve of the relay which causes the translation of said slide in the cavity of the relay to at all times follow the translation of said rod in the jack body, said connecting means having a mechanical flexibility permitting slight temporary displacements of the slide relative to the rod;

second disengageable connecting means between the jack rod and a movable memory plate serving as a support for the relay body having a clutch enabling said second connecting means to be made disengageable and two excitation electromagnets located respectively at each end of the slide valve and permitting a translation impulsion in one or other direction relative to the relay body to be communicated to said slide;

means for measuring the position of the plate at all times and electrical means permitting:

(a) either the displacement of the jack rod and the plate from one reference position to another by simultaneously effecting the excitation of one of the two electromagnets and the engagement of said second means, (b) or the storing in a memory of the state of the system by the position of the plate, said state remaining stationary until a new command is received.

The novel and advantageous arrangement of the servomotor compared with those of the prior art results from the existence of the movable plate which is linked by disengageable means with the movement of the jack piston and is displaced by the latter during reference position changes by using as the motor energy the compressed supply air of the system. This plate, which serves as a memory store because its position is at all times in biunivocal correspondence with that of the piston, is mounted on a friction system which means that it remains in the same state in the absence of any movement of said system. In the case of a failure of the electrical supply system controlling the servomotor the compressed air reservoir continues to distribute the pressures necessary on either side of the piston to maintain it in its state of equilibrium, and the memory store also remains in position.

The movements of said plate can essentially be of two different types, namely translation pure and simple parallel to that of the piston rod in which case it is the state of said translation which brings about the memory storage of the piston position, or a rotation about an axis and it is then the angular position of said memory store about said axis which is characteristic of the piston position.

The electropneumatic servomotor according to the invention obviously has, like all apparatus of this type, a conventional slaving loop which is realised by directly linking due to the mechanical flexibility the translation of the slide valve in the relay cavity with that of the piston in the jack body. In practice this flexibility is obtained by two spring blades fixed to a first rigid rod itself connected to the piston rod and spaced from one another by the length of the slide valve needle.

According to the invention the plate also supports the relay body, the clutch making it possible to render said plate integral with the second connecting means with the jack rod, as well as two excitation electromagnets located respectively at each end of the slide and which impart to the latter a translation impulsion in one or other direction relative to the relay body. The spring blades must have a flexibility which is determined in the following manner. They must be sufficiently rigid to maintain the slide valve in position, the latter being to a certain extent wedged between the two blades, but they must be sufficiently elastic to permit the slide valve, during a change in the reference position of the system, to temporarily react to the excitation of one of the two electromagnets and to move by a very small amount (a few tenths of a millimeter for example in one or other direction relative to the jack rod) until the servomotor has reestablished its position of equilibrium with the ferrules of the slide facing each of the two outlet nozzles of the relay.

The clutch used to temporarily fix the plate to the second connecting means with the piston can be of a random known type. However, according to the invention it is advantageous to use a pneumatic jack which is supplied directly through an electropneumatic valve by the compressed air reservoir of the installation.

The electrical controls of the servomotor forming the object of the invention essential comprise a differential amplifier which at its input receives an analogue voltage which is characteristic of the position of the plate (translation or rotation) and the control voltage by which the system is forced to adopt a given reference position. At the output the differential amplifier delivers a differential signal which supplies in parallel on the one hand the control of the pneumatic valve of the said clutch and on the other the two windings of the excitation electromagnets of the slide valve through two rectifiers of opposite directions to one another. The analogue voltage which electrically represents the position of the memory plate can be realised by any per se known system, the most simple being a potentiometric system on which an index linked with the plate samples a voltage which is variable as a function of the position of the latter. As a result of this system it is possible:

(a) by simultaneously realising the excitation of one of the two electromagnets and the clutch of the second means either to bring about the displacement of the jack rod and of the plate from one reference position to another;

(b) or store in a memory the state of the system by the position of the plate, said state remaining stationary until a new command is received.

In the case where the movement of the plate is a rotary movement about a shaft, the latter is itself subject to the action of a friction device in such a way that the plate retains its position in the case of a breakdown of the system and can retain its memory function. Moreover, rigid rod systems which in the version of the apparatus with displacement in translation of the memory plate served as the first and second mechanical means for connecting the slide valve and plate to the piston rod are replaced in this case by a linkage which transforms the translation of the piston into a rotary movement of the plate shaft and also ensures the positioning of the valve needle as a direct function of the displacement of the piston. A rotary clutch makes it possible to fix that part of the rotary shaft which is permanently under the action of the linkage to the part which supports the plate.

The invention will be better understood from the following description of three embodiments of the servomotor given in a non-limitative and illustrative form and with reference to the drawings, wherein show:

FIG. 1. the general diagram of an electropneumatic servomotor according to the invention in which the displacements of the memory plate are translations parallel to those of the piston.

Figure 2:
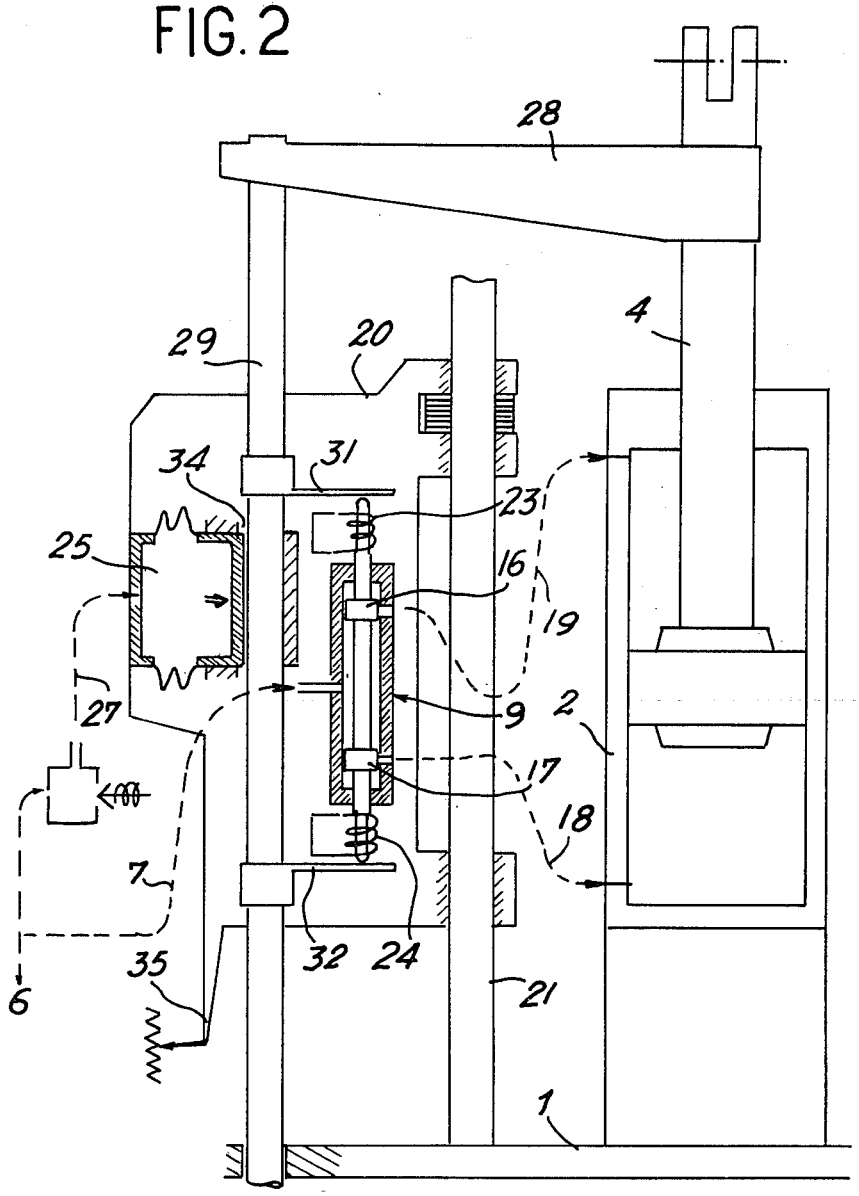

FIG. 2. a simplified embodiment of the servomotor of FIG. 1.

Figure 3:
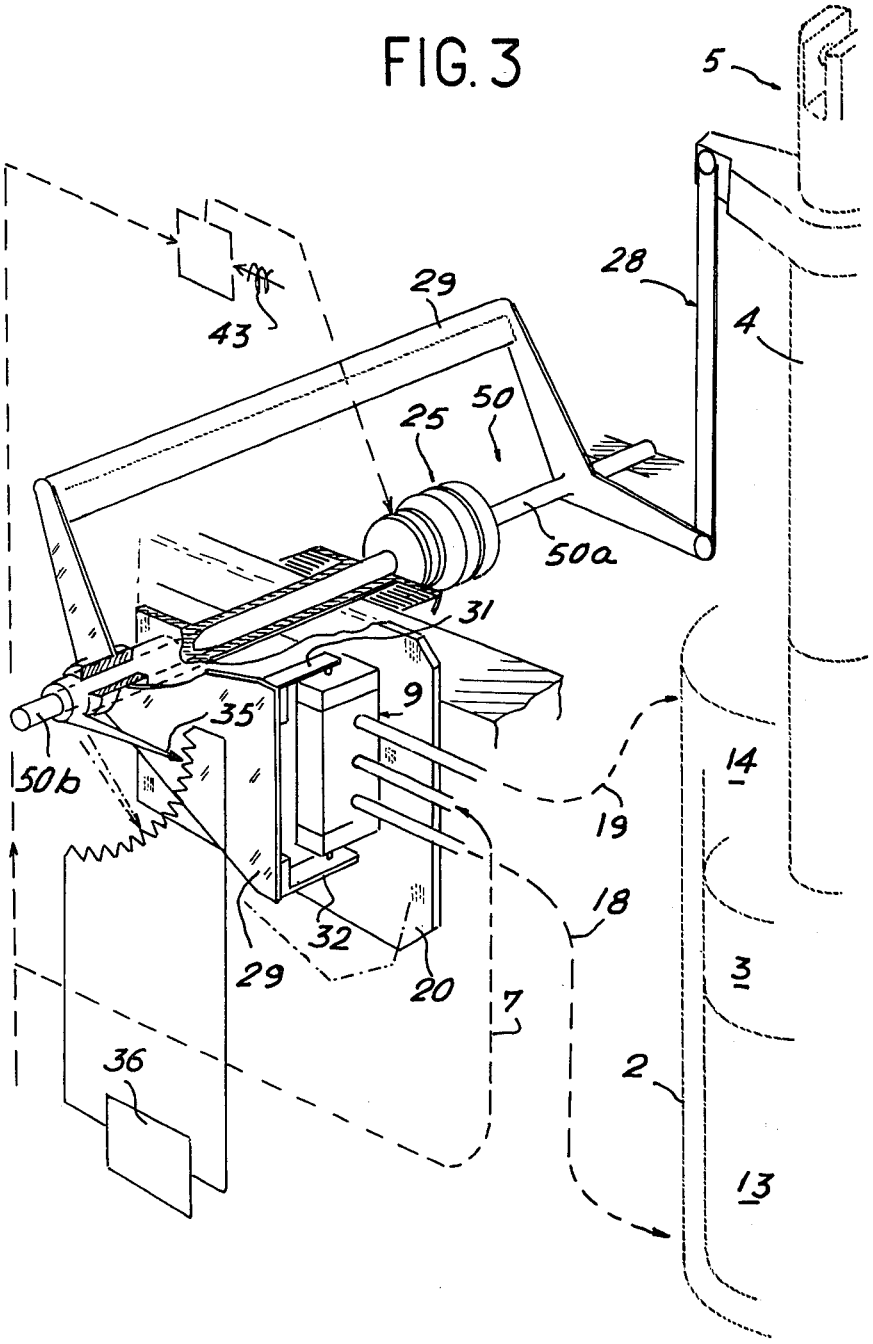

FIG. 3. a diagrammatic view of an embodiment of the invention in which the displacement of the memory plate is of the rotary type.

FIG. 1 shows fixed to the general frame 1 a jack body 2 in which is displaced a double acting piston 3, driving a rod 4 which controls the selected reference position for the not shown member, whose position is controlled by means of a connecting fork end. In conventional manner a compressed air reservoir 6 permanently supplies through a pipe 7 the central cylindrical cavity 8 of a pneumatic relay or slide-type pneumatic valve 9 by an intake nozzle 10, which issues into the median area of the central cavity 8 defined by a slide valve housing 9*a*. The two outlet nozzles 11 and 12 connected respectively to chambers 13 and 14 of jack body 2 by pipes 18 and 19 also issue into said central cylindrical cavity 8. A slide valve needle or spool 15 including and two ferrules 16 and 17 is able to move freely within the cylindrical cavity 8. Pipes 18 and 19, which connect the nozzles 11 and 12 to chambers 13 and 14, are made from a flexible material permitting the relative displacement of the members present, as well as the connection of pipes 7 to nozzle 10.

According to the invention a memory plate 20 is disposed so as to be able to move in translation along rod 21 via a friction system 22 which permits it to retain, in the absence of a significant mechanical stress, the positions reached during the operation of the servomotor. To plate 20 are fixed the body or housing 9*a* of relay or pneumatic valve 9, the two excitation electromagnets 23 and 24 located respectively at the two ends of slide valve spool 15, as well as pneumatic clutch 25 which receives by means of electropneumatic valve 26 and flexible tube 27 pressurised air from compressed air reservoir 6.

To the rod 4 of the jack is fixed a frame 28 to which are in turn attached rigid rods 29 and 30 constituting the first and second means for connecting piston 3 to the remainder of the apparatus. According to the invention rod 29, to which are fixed the two spring blades 31 and 32, slides freely at 33 through frame 1 of the apparatus and the two blades 31 and 32 are fixed to rod 29 at levels such that the normal spacing between these two blades corresponds to the length of the slide valve spool 15 which they maintain in position and on which they impose equal translations parallel to those of piston 3. When clutch 25 is not under pressure rod 30 slides freely in a cylindrical guide 34 traversing plate 20.

The position in translation of plate 20 is referenced by the numeral 35 which moves in front of the potentiometric system 36, thus permitting the tapping from electric line 37 a voltage which represents in analogue manner the translation state of memory plate 20. The following comments are made to provide a better understanding of the electrical part of the diagram of FIG. 1. For reasons of simplification this diagram is unifilar and 37 and 38 represent the two inputs of differential amplifier 39, input 38 being the input reserved for the control of the reference position of the servomotor. Output line 40 of differential amplifier 39 supplies in parallel three other excitation coils and specifically coil 23 through direct diode 41, coil 24 through inverted diode 42 and excitation coil 43 from electropneumatic valve 26. For reasons of clarity the three excitation coils 23, 24 and 43 are simultaneously shown at two different locations, that is to say in the overall electrical diagram and in the positions which they occupy in the apparatus.

Having described the various components of the servomotor the operation of the apparatus will now be described.

When the servomotor has reached a fixed reference position assigned to it by the choice of control voltage $V_1$ applied to the input 38 of differential amplifier 39 equilibrium exists between the voltages 37 and 38 and amplifier 39 supplies no voltage on its output line 40. Under these conditions relays 23, 24 and 43 are deenergized. Thus, slide valve spool 15 is located in the position represented in FIG. 1 where ferrules 16 and 17 have a symmetrical position relative to nozzles 11 and 12, thus balancing the pressures to chambers 13 and 14 and ensuring the stability of piston 3. Furthermore clutch 25 is not supplied with compressed air and plate 20 is only maintained in position by friction brake 22. The thus obtained state of the system is maintained until a reference position change is imposed on it.

If it is now desired to pass from one reference position to another the control voltage $V_1$ applied at the input 38 of amplifier 39 must be increased or decreased. The disequilibrium between the new reference voltage $V_1$ and the voltage tapped by 35 on memory potentiometer 36 is represented by amplifier 39 as a positive or negative voltage on output line 40. Whatever the sign of this output voltage the excitation coil 43 undergoes an excitation, leading to the closing of the corresponding valve 26 causing compressed air to be admitted into clutch 25 which at this moment renders integral rod 30 of plate 20, thereby destroying the normal control of the servomotor. Moreover, depending on whether the voltage on line 40 is positive or negative, one of the diodes 41 or 42 permits the passage of this voltage and one of the two electromagnets 23 or 24 is excited, which signifies that a slight displacement of slide valve spool 15 has taken place. In the case for example of electromagnet 23 there is an upward displacement, thus bringing the spring blade 31 into the position 31*a* indicated by dotted lines in the drawing. The compressed air supplied by nozzle 10 to relay or valve 9 then has a tendancy to escape more through nozzle 11 than through nozzle 12. The air pressure increases in chamber 14 and decreases in chamber 13, thus causing a movement of piston 3 and its rod 4 in the downward direction. Since according to the invention there is a correlative displacement under the motor influence of piston 3, on the one hand for plate 20 and on the other for slide valve spool 15 the assembly of plate 20 and relay moves in an unlimited manner downwards when electromagnet 23 is excited, because the ferrules 16 and 17 are off-centered relative to nozzles 11 and 12. When the new voltage $V_1$ applied at 38 balances the voltage read off the potentiometer at 37 due to the translation of sensor 35, the voltage on line 40 again becomes zero and the excitation of electromagnet 23 ceases under the influence of springs 31 and 32 and slide valve spool 15 reassumes its position of equilibrium relative to relay or valve 9. This position of equilibrium is determined by obtaining in chambers 13 and 14 pressures whose actions on jack 3 balance the force to which the latter is subject through the not shown mechanism to be regulated. The excitation of relay 43 also ceases, valve 26 again opens and clutch 25 is disengaged, thus freeing the memory plate 20 in its new waiting position.

As it is easy to gather from the drawing in the case of a power failure or an interruption in the supply to the system amplifier 39 no longer supplies a signal to the output line and both electromagnets 23 and 24 and relay 43 are deenergized. At this moment no further action can take place on slide valve 15 and disengaged plate 20 is maintained in its position which constitutes the memory of the system due to the friction means 22. As the air pressure is still ensured by compressed air reservoir 6 the normal control of the servomotor is perpetuated by rod 29 and a new change of reference position is possible on the basis of the previous position kept in the memory store by plate 20.

Thus, the apparatus according to the invention makes it possible to obtain an electropneumatic servomotor which has a true memory store, thus making it possible to combine the advantages of this type of servomotor with the advantages inherent in electrical servomotors.

Finally FIG. 3 shows a variant of an electropneumatic servomotor having a memory store in which plate 20 is of the rotary type. In general this drawing contains all the components of FIG. 1, which carry identical reference numerals. Frame 28 is replaced by a linkage which actuates in rotation, under the control of the displacements of piston 4, part 50*a* of shaft 50. This same linkage actuates a rigid frame 20 which displaces the two springs 31 and 32, as in the embodiment of FIG. 1 and constitutes a first slaving loop of the apparatus. The memory plate 20 is integral in rotation with the part 50*b* of shaft 50, which has a friction means 22 and can, as desired, be engaged with or disengaged from part 50*a* of shaft 50 by the rotary clutch 25. Thus, in this embodiment part 50*b* of the shaft constitutes the second slaving loop. Moreover sensor 35 connected to shaft 50 forming part of potentiometric system 36 must take into consideration an angular displacement to electrically materialise in analogue form the position occupied by memory plate 20.

Obviously the invention is not limited to the embodiments described hereinbefore and also applies for example to any single-acting servomotor in which one of the pressures on the piston is replaced by an antagonising spring and the slide valve is replaced by a nozzle-blade system. The two embodiments must be considered as equivalents and it has only been for reasons of clarity of the description that the description given hereinbefore has been provided relative to a double-acting piston.

What we claim is:

1. An electropneumatic apparatus comprising:

a jack assembly having a movable piston and rod;

a movable memory plate with position maintaining friction means;

potentiometer means for indicating the position of said plate at all times;

a pneumatic valve mounted on the memory plate, the pneumatic valve controlling the jack assembly to maintain it at a reference position established by the memory plate as indicated by the potentiometer means;

means for mechanically connecting the rod of the movable piston to the pneumatic valve, said means for connecting having a mechanical flexibility permitting slight temporary displacements of the movable piston relative to the plate which carries the pneumatic valve;

pneumatic clutch means for displacing the memory plate to change from said reference position to another reference position, said pneumatic clutch means being interconnected between the rod of the motor piston and said memory plate wherein actuation of the pneumatic clutch means mechanically connects, for concurrent movement, the rod to the memory plate; and valve actuating means for eliminating the controlling effects of the pneumatic valve, said valve actuating means acting simultaneously with the actuation of said pneumatic clutch means.

2. An electropneumatic apparatus as defined in claim 1, wherein the pneumatic valve includes:

an enclosed cylindrical cavity;

a slide valve spool movable in translation in said cavity; and three nozzles in communication with said cavity, one of the nozzles communicating between said cavity and a compressed air source having a certain reserve so as to ensure the permanent supply of pressurized air, and the two other nozzles communicating between said cavity and said jack assembly so as to ensure the distribution of air respectively in each of two chambers of said jack assembly, one of said chambers being located on one side of said piston and the other chamber being located on the opposite side of the piston wherein a pressure differential between the chambers causes movement of the piston, said two nozzles being blocked by said slide valve spool when the system is at equilibrium, said means for mechanically connecting the rod of the motor piston to said pneumatic valve causing the translation of said slide valve spool to at all times generally follow the translation of said rod in said jack assembly.

3. An electropneumatic apparatus as defined in claim 2, wherein the valve actuating means for eliminating the controlling effect of said pneumatic valve includes:

two excitation electromagnets, one located at one end of said slide valve spool, the other located at the other end of the slide valve spool; and electrical means for simultaneously actuating said pneumatic clutch means and one of the two excitation electromagnets.

4. An electropneumatic apparatus as defined in claim 3, wherein the position maintaining friction means includes:

a rigid rod fixed in position and extending parallel to the jack rod; and a friction clutch carried by the memory plate and engageable with the rigid rod.

5. An electropneumatic apparatus as defined in claim 4, wherein the means for mechanically connecting the rod of the motor piston to the pneumatic relay includes:

a rigid spring blade bearing rod attached to a frame fixed to the rod of the motor piston; and two spring blades fixed to said spring blade bearing rod at a distance from each other approximately equal to the length of the slide valve, wherein the mechanical flexibility of said means for connecting the rod of the motor piston to the pneumatic relay is provided by the two spring blades.

6. An electropneumatic apparatus as defined in claim 5, wherein the pneumatic clutch means for displacing the memory plate so as to change reference positions includes:

a rigid clutch-receiving rod fixed to the rod of the motor piston via said frame member; and a disengageable pneumatic clutch supplied by said compressed air source and mounted on said memory plate so as when actuated to engage said plate with said clutch-receiving rod in order to achieve concurrent movement, the pneumatic clutch being applied with air by an electropneumatic clutch control valve which controls the supply of air from said compressed air source to said pneumatic clutch.

7. An electropneumatic apparatus according to claim 6 wherein said electrical means for simultaneously actuating said pneumatic clutch means and one of said two excitation electromagnets, comprising:

a differential amplifier which receives at its input an analogue voltage which is characteristic of the position of the plate as determined by said potentiometric means and a control voltage indicative of a desired memory plate position, the amplifier supplying as output signal which is provided in parallel to control said electropneumatic valve for actuating said clutch means and to a pair of opposed rectifiers to supply one or the other of said excitation electromagnets depending upon the polarity of the output signal.

* * * * *

UNITED STATES PATENT AND TRADEMARK OFFICE

CERTIFICATE OF CORRECTION

PATENT NO. : 4,326,448

DATED : April 27, 1982

INVENTOR(S) : Jean Lejon

It is certified that error appears in the above—identified patent and that said Letters Patent is hereby corrected as shown below:

Column 6, line 57, after relay, insert "or valve 9".

Column 8, line 26, after two, insert "pressure".

Signed and Sealed this

*Third* Day of *August 1982*

[SEAL]

*Attest:*

GERALD J. MOSSINGHOFF

*Attesting Officer*

*Commissioner of Patents and Trademarks*